United States Patent [19]

Braden

[11] 4,004,688

[45] Jan. 25, 1977

[54] RADIAL LEADED ELECTRICAL COMPONENTS DESIGNED FOR AUTOMATIC INSERTION INTO PRINTED CIRCUIT BOARDS

[75] Inventor: Denver Braden, San Diego, Calif.

[73] Assignee: Illinois Tool Works Inc., Chicago, Ill.

[22] Filed: July 10, 1975

[21] Appl. No.: 594,929

[52] U.S. Cl. ..... 206/330; 206/331; 206/813; 338/322

[51] Int. Cl.[2] ..... B65D 73/02

[58] Field of Search ..... 29/630 R; 174/52 FP; 206/328, 330–331, 343–344, 460, 526, 813; 317/101 CC, 101 CW; 338/322; 339/17 CF, 17 F

[56] References Cited

UNITED STATES PATENTS

| | | | |
|---|---|---|---|
| 2,836,693 | 5/1958 | Yarbrough | 206/328 X |
| 3,092,253 | 6/1963 | Senger | 206/328 X |
| 3,472,366 | 10/1969 | Ackerman | 206/344 |
| 3,693,052 | 9/1972 | Galanti | 317/101 CC |

*Primary Examiner*—Steven E. Lipman
*Attorney, Agent, or Firm*—Glenn W. Bowen; Robert W. Beart

[57] ABSTRACT

Radial leaded electrical components are adapted for use with automatic insertion machinery in accordance with the present invention by providing a V-shaped deformation in their leads so that they may be retained between two parallel bands of adhesive tape. These components may then be wound onto a reel together or they may be wound onto a reel along with other electrical components of either the axial or radial type in a predetermined sequence so that they may be inserted by automatic insertion equipment into printed circuit boards at the proper locations.

12 Claims, 8 Drawing Figures

RADIAL LEADED ELECTRICAL COMPONENTS DESIGNED FOR AUTOMATIC INSERTION INTO PRINTED CIRCUIT BOARDS

BACKGROUND OF THE INVENTION

Commercial automatic inserting machines are available which offer tremendous labor savings costs by providing for the rapid insertion of discrete electrical components into printed circuit boards. These machines are specifically designed for the insertion of axial leaded electrical components which have their leads aligned parallel to each other. The outer ends of the axial leads of a component are held by two parallel bands of adhesive tape and the entire package is then wound onto a reel for shipment.

Axial leaded components may be packaged so that several thousand capacitors may be contained on one reel, several thousand electrical resistors may be packaged on a second reel, several thousand diodes may be packaged on still another reel. After the various components are packaged on their separate reels, they may be loaded onto a master sequencing machine which is controlled by a sequencing computer. The sequencing computer automatically selects and removes the desired components from the individual reels in a predetermined sequence. These components are then fed onto a conveyor chain one behind the other, a fraction of an inch apart, and are retaped into what is called a master reel package. The master reel package is then fed into the inserting machine which inserts the components, one at a time, into a pre-drilled printed circuit board that is indexed into position under the insertion jaws by a computer-controlled positioning table. After insertion of the components into the printed circuit board, the leads are cut to size and are clenched on the under side of the printed circuit board so that they will stay in position during a subsequent wave soldering operation.

The automatic insertion machinery described above is highly cost effective, however, but it could not, prior to this invention, effectively handle certain components which are not of the axial leaded variety that are often required in electrical circuits. For example, in many circuits capacitors of a high value or a high voltage rating may be required; and this type of capacitors is often constructed with radial leads due to cost considerations. Prior to the present invention, these radial leaded capacitors had to be hand fed into the printed circuit boards separately at a labor rate which was many times higher than that of an automatic insertion machine. The present invention provides a technique whereby radial leaded components may be packaged into a reel, sequenced and automatically inserted into printed circuit boards with essentially the same sequencing and automatic insertion equipment that is now presently used for axial leaded components.

DESCRIPTION OF THE DRAWINGS

The present invention is illustrated by reference to the drawings in which.

TECHNICAL DESCRIPTION OF THE INVENTION

Figure 1:
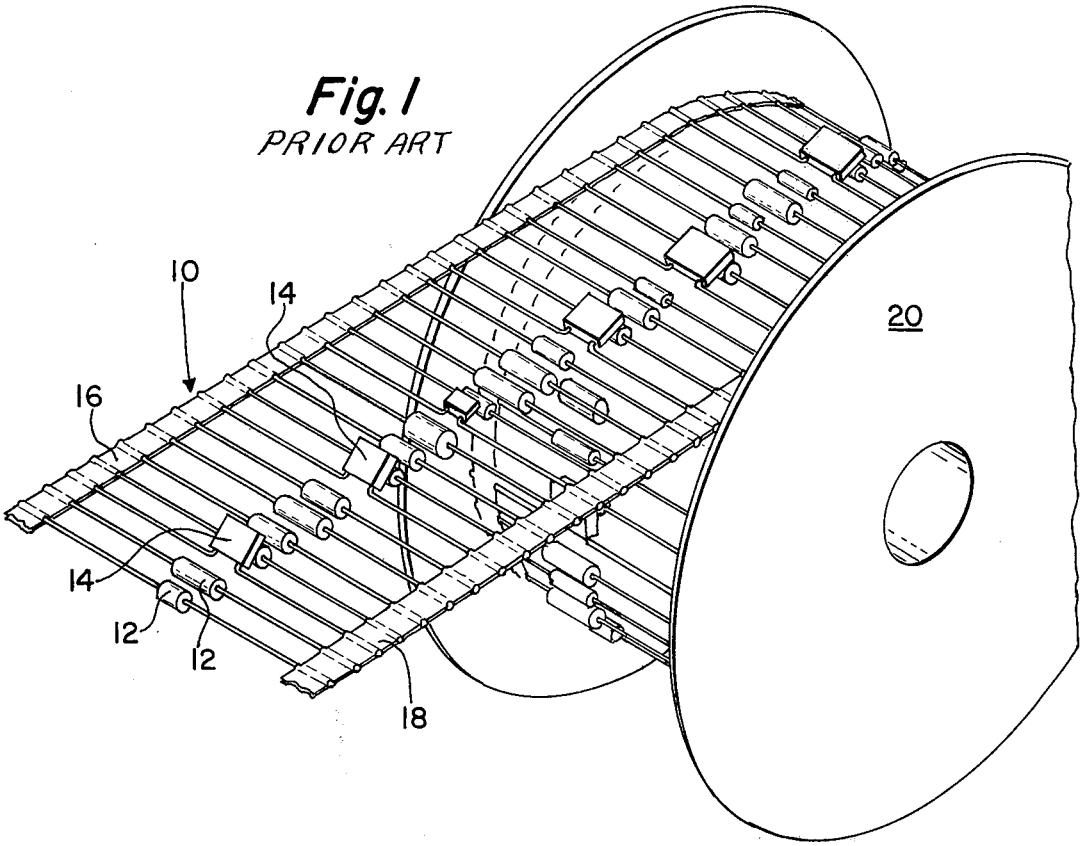
Fig. 1 PRIOR ART
FIG. 1 represents a perspective view of a combined axial and radial lead component package on a single reel which does not utilize the present invention.

Currently employed reel packaging and automatic lead insertion equipment utilize axial leaded components that are spaced about 0.2 inches apart and are retained between two parallel bands of adhesive tape. While it is not known if it has actually been attempted to combine axial and radial lead components in a reel package for automatic insertion equipment, the result that would occur if such an attempt were made is shown on the perspective view of FIG. 1. In FIG. 1 the package strip 10 is formed of axial leaded components 12, radial leaded components 14 and the adhesive tape bands 16, 18 which secure the components together so they may be wound on the packaging reel 20.

The package that is thus formed is not satisfactory for automatic insertion since the radial components 14 may rotate and there is no assurance they will be positioned at right angles to the tape bands 16, 18 when they are unreeled. Without this assurance, a number of components probably would be damaged as the insertion jaws of the automatic inserting equipment (not shown) engage the leads of the radial leaded components 14 and insert the component into a printed circuit board (not shown) in which the components are usually very closely spaced. The alternative of providing a larger circuit board is, of course, not very satisfactory one for many applications in which size and weight reduction is of the upmost importance.

Figure 2:
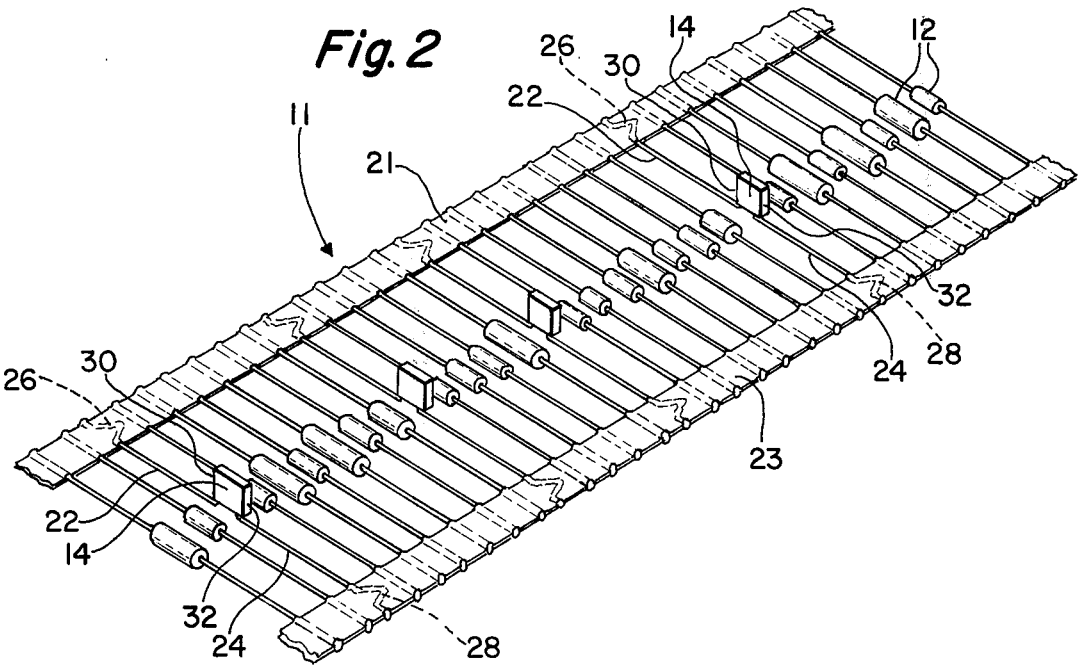
FIG. 2 shows a portion of a strip in which both axial and radial lead components formed in accordance with the present invention are packaged together with two parallel bands of adhesive tape.
Figure 4:
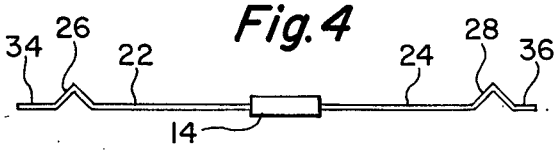
FIG. 4 is a top view showing a single radial leaded axial capacitor which has its leads deformed in accordance with the present invention.
Figure 5:
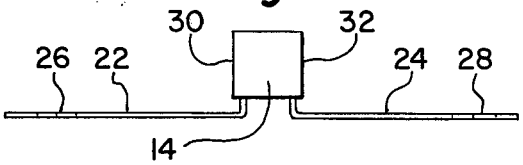
FIG. 5 is a side view of the radial leaded capacitor of FIG. 4.
Figure 6:
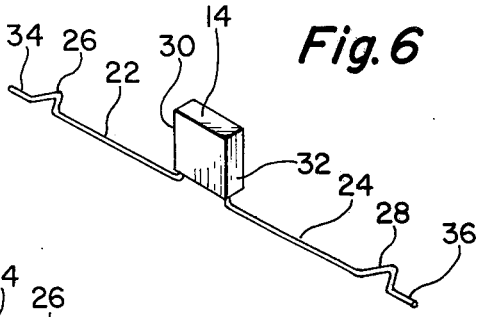
FIG. 6 is a perspective view showing the radial leaded capacitor of FIG. 4.

FIGS. 4–6 show a radial leaded component 14 in which the leads 22, 24 extend along substantially a straight line and substantially in the same plane, and each have a deformation 26, 28, respectively, which allows the component 14 to be inserted into a sequenced reel package such as the package 11 shown in FIG. 2, which solves the above-noted problems. The deformations 26, 28, it will be noted, are preferably V-shaped bends which substantially lie in the plane which is substantially normal to the vertical sides 30, 32 of the component body 14 and which contains the leads 22, 24. It is preferred that both V-shaped deformations point in the same directions as illustrated, but this is not essential. When the components 14 are in the package 11 their sides 30, 32 are positioned so that they are substantially normal to the adhesive tape bands 21, 23 which prevent the components 14 from rotating in the package after they are initially positioned. The package 11 which is formed thereby allows for clearance when the components 14 are being inserted into a printed circuit board. Components with more than two leads may utilize the teachings of the present invention by bringing the extra leads out to one side or the other of the package, where they may be taped into the package.

In FIGS. 4 through 6, the component 14 is shown with the deformations 26, 28 adjacent the end of the leads 22, 24 respectively. It is to be noted, however, that there are a pair of short extension portions 34, 36, which extend beyond the deformations 26, 28 respectively. These short extension portions allow for the radial leaded components 14 to be packaged in a component package 38 prior to their being packaged in the sequenced package 11 of FIG. 2. The adhesive tape bands 40, 42 are employed to complete the package with the tape band 40 being taped over the extension 34 and the tape band 42 being taped over the extension 36. The package 38 may be rolled on a reel and shipped by a capacitor manufacturer to a customer who may then produce the sequenced package 11. The components 14 on the master package 38 may be removed merely at the customer's location by severing the extension portions 34, 36 from the remaining portions of the leads 22, 24 in the package 38. The component 14 may then drop onto a conveyor chain or belt and pass to the sequencing equipment.

Figure 3:
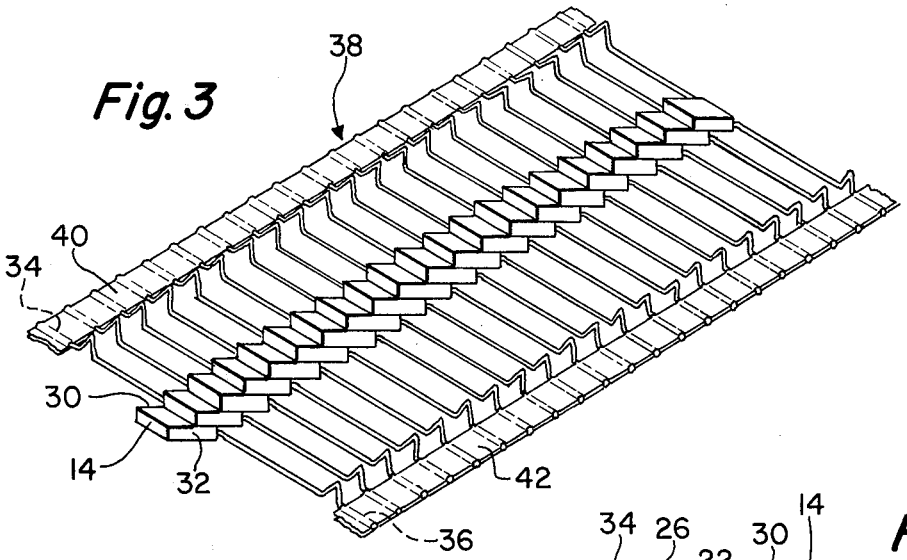
FIG. 3 shows a reel package strip in which two parallel bands of adhesive tape are used to hold components of the same type, such as radial leaded electrical capacitors, together in a package.
Figure 7:
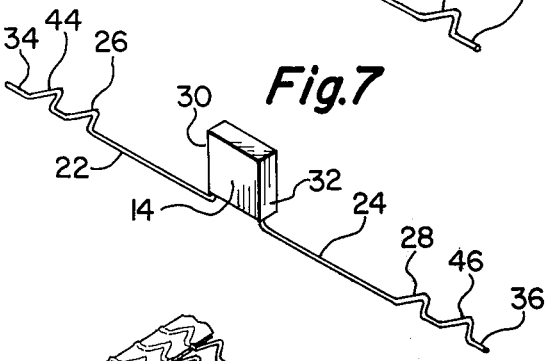
FIG. 7 is a perspective view of an alternate embodiment of a radial lead capacitor of the present invention in which two sets of deformations are employed.
Figure 8:
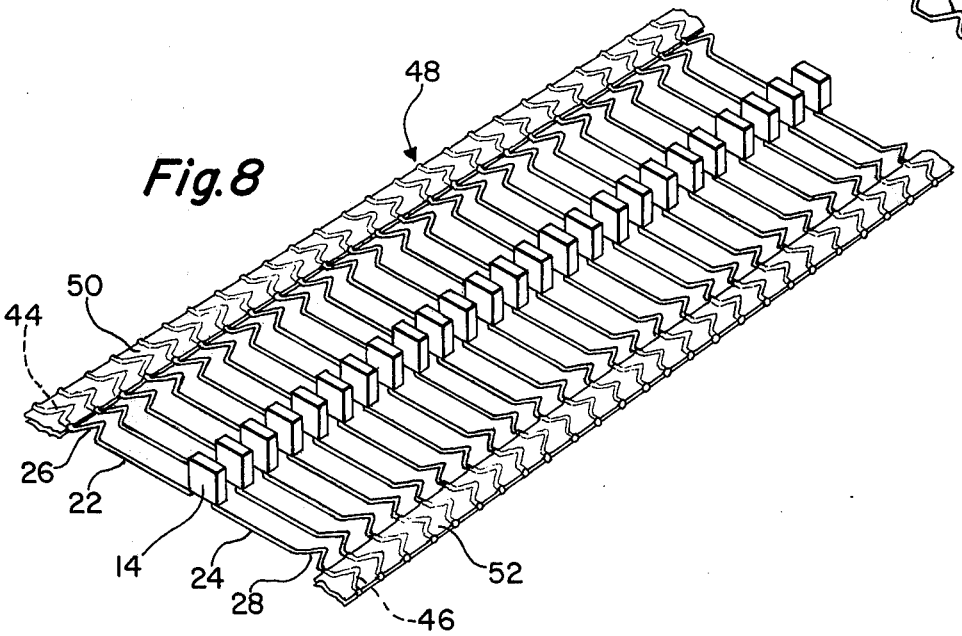
FIG. 8 is a package in which two parallel bands of adhesive tape secure the radial leaded capacitors of FIG. 7 into a package strip.

The radial leaded component 14 of FIG. 7 is of a radial leaded construction in which the leads 22, 24 include additional deformations 44, 46 between the deformations 26, 28 and the extension portions 34, 36. The purpose of these deformations is shown in FIG. 8 wherein a master reel package 48 is formed so that the radial leaded components 14 are retained in a vertical position with their sides 30, 32 positioned substantially normal to the adhesive tape bands 50, 52. In this instance, the tape bands 50, 52 pass over the outboard deformations 44, 46 so that the leads 22, 24 may be severed, thereby removing the deformations 44, 46 and the extension portions 34, 36, while retaining the deformations 26, 28. After this severing operation the components 14 from the package 48 of FIG. 8 will be substantially identical to the components 14 of FIG. 6, so that after sequencing and retaping, the package 11 of FIG. 2 may be formed. The components in the package 48 of FIG. 8 are not allowed to rotate even in the master package as they might in the component master package 38 of FIG. 3.

The invention is claimed as follows:

1. A radial leaded electrical component comprising at least first and second radial leads which project outwardly in opposite directions along substantially a straight line and which lie in substantially the same plane, a first deformation in said first lead, said first deformation being positioned and configurated to insure the application of a first adhesive band over said first deformation and the application of a second adhesive band over said second lead retains said component in a predetermined orientation relative to said plane and a second deformation positioned on said first lead outwardly of said first deformation.

2. A radial leaded electrical component as claimed in claim 1 wherein said deformations are V-shaped deformations which lie substantially in said plane near the end of said first lead.

3. A radial leaded electrical component comprising at least first and second radial leads which project outwardly in opposite directions along substantially a straight line and which lie in substantially the same plane, a first deformation in said first lead and a second deformation in said second lead, said first and second deformations being positioned and configurated to insure that the application of a first adhesive band over said first deformation and the application of a second adhesive band over said second deformation retains said component in a predetermined orientation relative to said plane and a third deformation positioned outwardly of said first deformation on said first lead and a fourth deformation positioned outwardly of said second deformation on said second lead.

4. A radial leaded electrical component as claimed in claim 3 wherein said deformations are V-shaped deformations which lie substantially in said plane near the ends of said leads.

5. A radial leaded electrical component package comprising a plurality of components each having a body and at least first and second radial leads which project outwardly from said body in opposite directions along substantially a straight line and which lie in substantially the same plane, a first deformation in one of said first and second leads of each component of the radial leaded type and first and second adhesive bands, applied to all of said first and said second leads, respectively, with said adhesive bands aligned substantially parallel to each other and with said body of each of said components being supported between said adhesive bands, said first deformation being positioned and configurated to insure that said adhesive bands retain each of said radial lead components in a predetermined orientation relative to said plane.

6. A radial leaded electrical component package as claimed in claim 5 wherein said first deformation is a V-shaped deformation which lies substantially in said plane near the end of the lead in which it is formed.

7. A radial leaded electrical component package as claimed in claim 5 comprising a second deformation positioned outwardly of said first deformation in each of said leads which have said first deformation formed therein.

8. A radial leaded electrical component package as claimed in claim 7 wherein said deformations are V-shaped deformations which lie substantially in said plane near the end of said first lead.

9. A radial leaded electrical component package comprising a plurality of components each having a body and at least first and second radial leads which project outwardly from said body in opposite directions along substantially a straight line and which lie in substantially the same plane, a first deformation in each of said first lead of each component of the radial leaded type and a second deformation in each of said second leads of each component of the radial leaded type and first and second adhesive bands, applied to all of said first and said second leads, respectively, with said adhesive bands aligned substantially parallel to each other and with said body of each of said components being supported between said adhesive bands, said first and second deformations being positioned and configurated to insure that said adhesive bands retain each of said radial leaded components in a predetermined orientation relative to said plane.

10. A radial leaded electrical component package as claimed in claim 9 wherein said deformations are V-shaped deformations which lie substantially in said plane near the ends of said leads.

11. A radial leaded electrical component package as claimed im claim 1 comprising a third deformation positioned outwardly of said first deformation on said first lead and a fourth deformation positioned outwardly of said second deformation on said second lead.

12. A radial leaded electrical component package as claimed in claim 11 wherein said deformations are V-shaped deformations which lie substantially in said plane near the ends of said leads.

* * * * *